US009459014B2

(12) United States Patent
Hattori et al.

(10) Patent No.: US 9,459,014 B2
(45) Date of Patent: Oct. 4, 2016

(54) AIR CONDITIONING SYSTEM AND AIR CONDITIONING METHOD

(75) Inventors: Shinji Hattori, Tokyo (JP); Taichi Ishizaka, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 505 days.

(21) Appl. No.: 13/822,274

(22) PCT Filed: Jan. 25, 2011

(86) PCT No.: PCT/JP2011/051372

§ 371 (c)(1),
(2), (4) Date: Mar. 11, 2013

(87) PCT Pub. No.: WO2012/035788

PCT Pub. Date: Mar. 22, 2012

(65) Prior Publication Data

US 2013/0166074 A1 Jun. 27, 2013

(30) Foreign Application Priority Data

Sep. 17, 2010 (JP) ..... 2010-210120

(51) Int. Cl.
*G05B 13/00* (2006.01)
*G05B 15/00* (2006.01)
(Continued)

(52) U.S. Cl.
CPC ..... *F24F 3/00* (2013.01); *F24F 11/001* (2013.01); *F24F 11/04* (2013.01)

(58) Field of Classification Search
CPC ..... F24F 3/00; F24F 11/04; F24F 12/00; F24F 13/00; F24F 13/07; F24F 13/08; B60H 1/00
USPC ..... 454/75, 76, 259, 333; 165/237, 300; 62/93, 179, 186, 259, 407, 408
See application file for complete search history.

(56) References Cited

U.S. PATENT DOCUMENTS 5,478,276 A 12/1995 Lee
2004/0079094 A1* 4/2004 Kasai et al. ..... 62/186
(Continued)

FOREIGN PATENT DOCUMENTS

JP 2004150731 A 5/2004
JP 2005016885 A 1/2005
(Continued)

OTHER PUBLICATIONS

International Search Report of the International Searching Authority mailed May 10, 2011 for the corresponding international application No. PCT/JP2011/051372 (with English translation).
(Continued)

*Primary Examiner* — Mohammad Ali
*Assistant Examiner* — Md Azad
(74) *Attorney, Agent, or Firm* — Posz Law Group, PLC

(57) ABSTRACT

The present invention adjusts the discharge rate or discharge direction of air-conditioned air discharged from the discharge openings of air conditioners ($\mathbf{30}_1$ to $\mathbf{30}_8$) according to the occupancy rates of work areas in the air-conditioned regions of the air conditioners ($\mathbf{30}_1$ to $\mathbf{30}_8$). In this way, the work areas are intensively air-conditioned and the aisles and the space where cabinets and multifunctional machines are provided are moderately air-conditioned. Consequently, creating a comfortable environment around the users working in the work areas and reduce the energy consumption required for air-conditioning is possible.

13 Claims, 11 Drawing Sheets

(51) Int. Cl.

| | |
|---|---|
| ***G05D 23/00*** | (2006.01) |
| ***F25D 17/00*** | (2006.01) |
| ***F25D 17/04*** | (2006.01) |
| ***F25D 17/06*** | (2006.01) |
| ***F24F 11/00*** | (2006.01) |
| ***F24F 3/00*** | (2006.01) |
| *F24F 11/04* | (2006.01) |

(56) References Cited

U.S. PATENT DOCUMENTS

| | | | | |
|---|---|---|---|---|
| 2010/0036533 | A1* | 2/2010 | Masuda et al. | 700/278 |
| 2010/0174414 | A1 | 7/2010 | Takagi et al. | |
| 2011/0277982 | A1* | 11/2011 | Kim et al. | 165/237 |
| 2012/0174608 | A1* | 7/2012 | Kumamoto et al. | 62/186 |

FOREIGN PATENT DOCUMENTS

| | | | |
|---|---|---|---|
| JP | 2008196842 | A | 8/2008 |
| JP | 2008298313 | A | 12/2008 |
| JP | 2009186136 | A | 8/2009 |
| JP | 4337427 | B2 | 9/2009 |
| JP | 2010159905 | A | 7/2010 |

OTHER PUBLICATIONS

Office Action mailed Nov. 26, 2013 issued in corresponding JP patent application No. 2012-533876 (and partial English translation).

Office Action dated May 4, 2015 issued in corresponding CN patent application No. 201180043762.4 (and partial English translation).

* cited by examiner

FIG.3

AIR CONDITIONER MODEL INFORMATION

| NAME | DISCHARGE DIRECTION | DISCHARGE RATE | SWING FUNCTION |
|---|---|---|---|
| AIR CONDITIONER $30_1$ | 4 DIRECTIONS | 4 LEVELS | YES |
| AIR CONDITIONER $30_2$ | 4 DIRECTIONS | 4 LEVELS | YES |
| ⋮ | ⋮ | ⋮ | ⋮ |
| AIR CONDITIONER $30_8$ | 4 DIRECTIONS | 4 LEVELS | YES |

FIG.4

AIR CONDITIONER POSITION INFORMATION

| NAME | X POSITION | Y POSITION |
|---|---|---|
| AIR CONDITIONER $30_1$ | 1. 8 | 6. 3 |
| AIR CONDITIONER $30_2$ | 8. 2 | 6. 3 |
| ⋮ | ⋮ | ⋮ |
| AIR CONDITIONER $30_8$ | 21. 0 | 1. 8 |

FIG.5

SEAT POSITION INFORMATION

| NAME | X POSITION | Y POSITION | WIDTH | DEPTH |
|---|---|---|---|---|
| WORK AREA A1 | 1. 7 | 1. 6 | 11. 5 | 6. 1 |
| WORK AREA A2 | 4. 5 | 1. 6 | 11. 5 | 6. 1 |
| WORK AREA A3 | 18. 3 | 1. 6 | 11. 5 | 6. 1 |
| WORK AREA A4 | 21. 1 | 1. 6 | 11. 5 | 6. 1 |

AIR CONDITIONING SYSTEM AND AIR CONDITIONING METHOD

CROSS REFERENCE TO RELATED APPLICATIONS

This application is a U.S. national stage application of PCT/JP2011/051372 filed on Jan. 25, 2011, and claims priority to, and incorporates by reference, Japanese Patent Application No. 2010-210120 filed on Sep. 17, 2010.

TECHNICAL FIELD

The present invention relates to an air conditioning system and air conditioning method, and more particularly to an air conditioning system and air conditioning method for air-conditioning a space.

BACKGROUND ART

In association with the recent global warming of the earth and worldwide economical and industrial advancement, making efforts to reduce $CO_2$ discharge or reduce energy consumption has been considered to be important. With such background circumstances, various techniques have been proposed for reducing the energy consumption in office buildings and/or large stores and promoting energy saving (for example, see Patent Literature 1 and 2).

The air conditioning device described in Patent Literature 1 divides a space to be air-conditioned and defines multiple small areas. Subsequently, the device measures the radiation temperature in each small area and determines the air-conditioned air discharge rate based on the temperature difference between the small areas. Then, the device determines the air-conditioned air discharge direction so that the air-conditioned air flows toward the area where the radiation temperature is higher.

The air conditioning device described in Patent Literature 2 measures the distances between the installation position of the air conditioning device and the walls surrounding the air conditioning device using ultrasonic sensors or the like, and presumes the shape of the room to be air-conditioned. Then, the device determines the air-conditioned air discharge direction and discharge angle in consideration of the shape of the room and the position of the air-conditioned air discharge opening.

PRIOR ART LITERATURE

Patent Literature

Patent Literature 1: Japanese Patent No. 4337427; and
Patent Literature 2: Japanese Patent No. 2723470.

DISCLOSURE OF THE INVENTION

Problem to be Solved by the Invention

Using the air conditioning devices described in the Patent Literature 1 and 2, the entire space will be air-conditioned evenly. However, these devices air-condition a space regardless of the human distribution; therefore, air-conditioning control for a space with nobody therein inconveniently causes wasteful energy consumption.

The present invention is invented in view of the above circumstances and an exemplary objective of the present invention is to create a comfortable environment around people in a space and reduce the energy consumption by air-conditioning the space in consideration of the positions of people therein.

Means for Solving the Problem

In order to achieve the above objective, the air conditioning system according to a first exemplary aspect of the present invention comprises:

multiple discharge openings dispersed in a space to be air-conditioned and discharging air-conditioned air;

a discharge rate calculation means calculating, for each of the discharge openings, the discharge rate of the air-conditioned air discharged from the discharge opening according to the ratio of user work areas to the air-conditioned region assigned to the discharge opening; and a discharge rate adjustment mean adjusting the discharge rates of the air-conditioned air discharged from the discharge openings based on the calculation results of the discharge rate calculation means.

The air conditioning system according to a second exemplary aspect of the present invention comprises:

multiple first air conditioners dispersed in a space to be air-conditioned and capable of changing the angle of the air-conditioned air discharge direction among multiple levels from the horizontal direction to the vertical direction;

a specifying means dividing the air-conditioned region of the first air conditioner into multiple small regions based on the distance from the installation position of the first air conditioner and specifying a small region including the area the users work inmost;

an angle calculation means calculating the angle of the discharge direction for discharging the air-conditioned air toward the small region specified by the specifying means; and an angle adjustment means adjusting the angle of the discharge direction based on the calculation results of the angle calculation means.

The air conditioning method according to a third exemplary aspect of the present invention includes the steps of:

calculating, for each of the discharge openings, the discharge rate of air-conditioned air discharged from the discharge opening according to the ratio of user work areas to the air-conditioned region assigned to multiple discharge openings dispersed in a space to be air-conditioned and discharging the air-conditioned air; and discharging the air-conditioned air from each of the discharge openings at the calculated discharge rate.

The air conditioning method according to a fourth exemplary aspect of the present invention is an air conditioning method for air-conditioning a space to be air-conditioned using air conditioners dispersed in the space and capable of changing the angle of the air-conditioned air discharge direction among multiple levels from the horizontal direction to the vertical direction, including the steps of:

dividing the air-conditioned region of the air conditioner into multiple small regions based on the distance from the installation position of the air conditioner;

specifying a small region including the area users work in most;

calculating the angle of the discharge direction for discharging the air-conditioned air toward the specified small region; and adjusting the angle of the discharge direction for the calculated angle.

Effects of the Invention

The present invention determines the discharge rate and discharge direction of air-conditioned air discharged from the discharge openings in consideration of user work areas. Consequently, priority is given to air conditioning around the users and the air conditioning for the areas where probably there are no users is reduced. Hence, creating a comfortable environment around the users in a space and reduce the energy consumption is possible.

BRIEF DESCRIPTION OF DRAWINGS

FIG. 3 is an illustration showing a data table regarding the air conditioner model information;

FIG. 4 is an illustration showing a data table regarding the air conditioner position information;

FIG. 5 is an illustration showing a data table regarding the seat position information;

MODE FOR CARRYING OUT THE INVENTION

<Embodiment 1>

Figure 1:
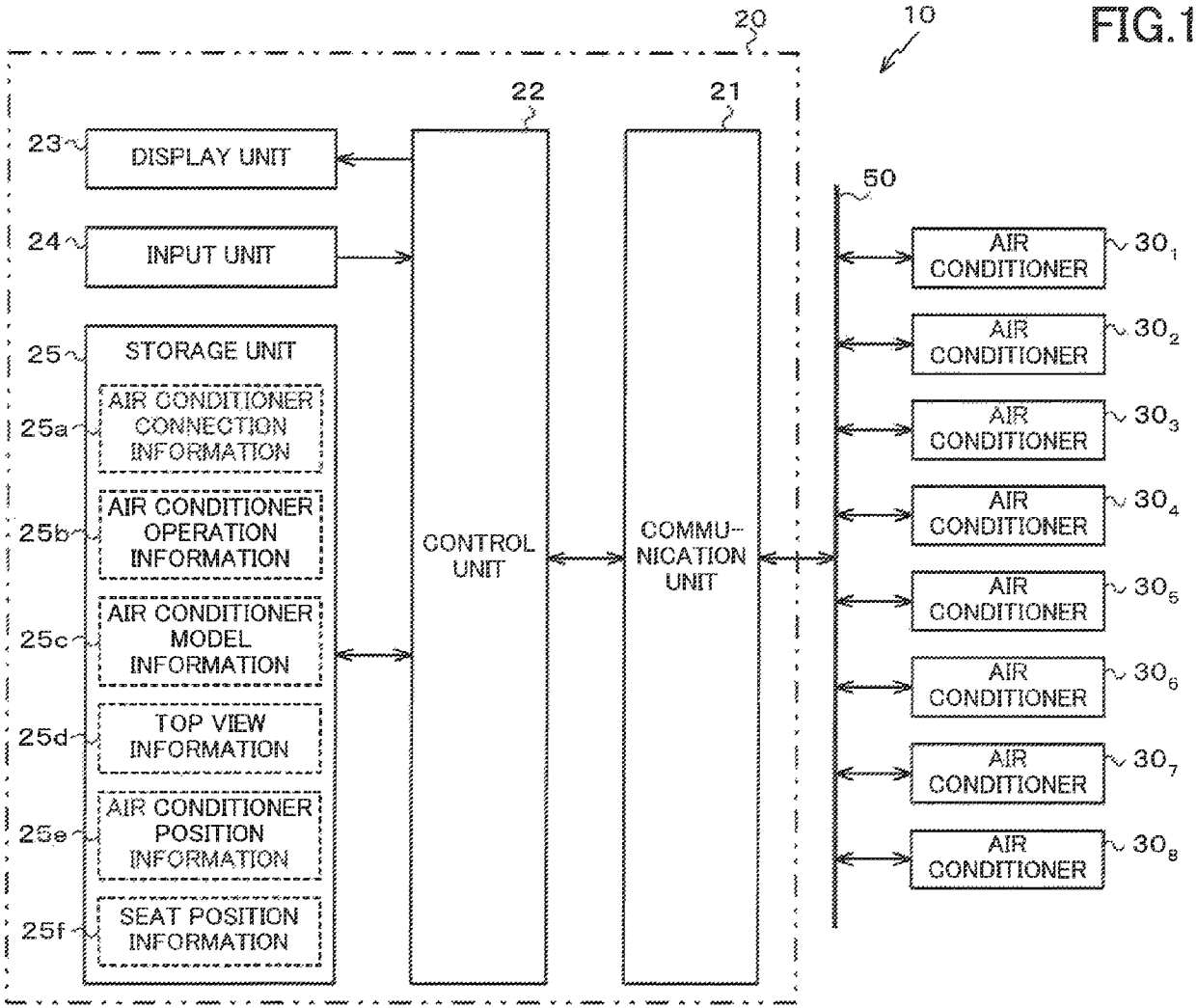
FIG. 1 is a block diagram of the air conditioning system according to Embodiment 1.

Embodiment 1 of the present invention will be described hereafter with reference to the drawings. FIG. 1 is a block diagram of an air conditioning system 10 according to this embodiment. The air conditioning system 10 is a system for air-conditioning a space such as a store or office where multiple users are present for desk work and/or the like.

As shown in FIG. 1, the air conditioning system 10 has a management device 20 and eight air conditioners 30 connected to the management device 20 via a network 50.

The management device 20 has a communication unit 21, a control unit 22, a display unit 23, an input unit 24, and a storage unit 25.

The communication unit 21 is constructed to include, for example, an air conditioning control-specific communication interface, serial interface, or LAN (local area network) interface. The management device 20 is connected to the network 50 via the communication unit 21.

The display unit 23 is constructed to include an LCD (liquid crystal display) or CRT (cathode ray tube). The display unit 23 displays processing results of the control unit 22 and the operation states of the air conditioners 30.

Figure 2:
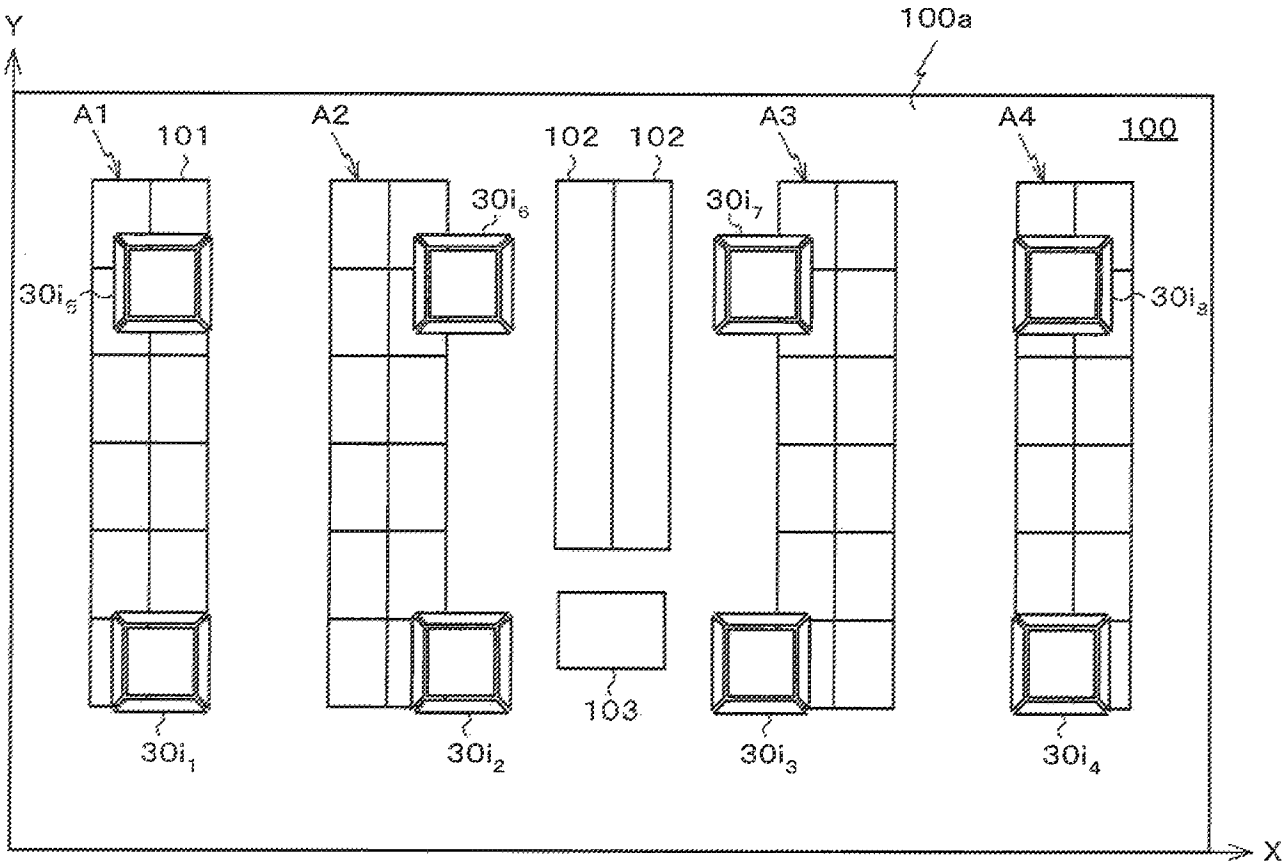
FIG. 2 is an illustration showing an exemplary screen displayed on the display unit.

FIG. 2 is an illustration showing an exemplary graphic screen displayed on the display unit 23. This graphic screen consists of an image of the floor 100*a* of a space 100, images presenting desks 101, cabinets 102, and a multifunctional machine 103 installed in the space 100, and eight icons $\mathbf{30}i_1$ to $\mathbf{30}i_8$ displayed over these images. The icons $\mathbf{30}i_1$ to $\mathbf{30}i_8$ represent the air conditioners $\mathbf{30}_1$ to $\mathbf{30}_8$. The positions where these icons $\mathbf{30}i_1$ to $\mathbf{30}i_8$ are displayed correspond to the positions of the air conditioners $\mathbf{30}_1$ to $\mathbf{30}_8$ in the space 100. Furthermore, the icons 306 to $\mathbf{30}i_8$ change in display color according to, for example, the air-conditioned air discharge rates and/or the operation states of the air conditioners $\mathbf{30}_1$ to $\mathbf{30}_8$.

The input unit 24 is constructed to include a keyboard and/or touch panel. Operator instructions are informed to the control unit 22 via the input unit 24.

The storage unit 25 is constructed to include a nonvolatile memory such as a magnetic disc and semiconductor memory. The storage unit 25 stores, in regard to the air conditioners 30, air conditioner connection information 25*a*, air conditioner operation information 25*b*, air conditioner model information 25*c*, top view information 25*d*, air conditioner position information 25*e*, and seat position information 25*f*.

The air conditioner connection information 25*a* includes information regarding the address numbers of the air conditioners 30 to be managed by the management device 20 and, when the air conditioners 30 are grouped, information regarding the groups the air conditioners 30 belong to. The air conditioner connection information 25*a* is entered by the administrator of the air conditioning system 10 or the like upon startup of the air conditioning system 10.

The air conditioner operation information 25*b* includes information regarding the output power, operation mode such as cooling or heating, and set temperature of each air conditioner 30, the temperature around the air conditioner 30, and the air-conditioned air discharge rate and discharge direction. The air conditioner operation information 25*b* is updated in sequence as the control unit 22 communicates with the air conditioners 30 via the communication unit 21.

The air conditioner model information 25*c* is, as seen for example with reference to the data table shown in FIG. 3, information including, for each air conditioner 30, the number of air-conditioned air discharge directions, number of switchable levels of air-conditioned air discharge rate, and presence/absence of the swing function. Here, the number of switchable levels of discharge rate indicates that, if it is, for example, 4, the discharge rate can be adjusted among four levels.

Received by the management device 20 from each air conditioner 30 via the network 50, the air conditioner model information 25*c* is acquired. Here, the administrator of the air conditioning system 10 can enter the air conditioner model information 25*c* via the input unit 24.

The top view information 25*d* consists of image data of the floor 100*a* constituting the space 100. The image data are, for example, electronic data presenting the layout diagram of the space 100 and entered by the administrator of the air conditioning system 10. The image data are, as seen with reference to FIG. 2, displayed on the display unit 23.

The air conditioner position information 25*e* is, as seen for example with reference to the data table shown in FIG. 4, information presenting the positions of the air conditioners 30 in the space 100. Here, the positions of the air conditioners 30 are represented by their center positions. The icons 30*i* shown in FIG. 2 are placed on the screen based on the air conditioner position information 25*e*.

The positions of the air conditioners 30 are, as seen with reference to FIG. 2, defined by the position coordinates in the XY coordinate system with the origin at the bottom left corner of the floor 100*a* constituting the space 100*a*. The X-coordinate of the position coordinates is equal to the distance from the origin in the direction parallel to the X-axis and the Y-coordinate thereof is equal to the distance from the origin in the direction parallel to the Y-axis as shown in the data table of FIG. 4. The positions of the icons 30*i* on the screen shown in FIG. 2 are defined by the air conditioner position information 25*e*.

The seat position information 25*f* is, as seen for example with reference to the data table shown in FIG. 5, information presenting the positions and sizes of work areas A1 to A4 constituted by 12 desks 101. Here, the positions of the work areas A1 to A4 are the positions of the bottom left corners of the work areas A1 to A4. The positions of the work areas A1 to A4 shown in FIG. 2 are defined by the seat position information 25*f*.

The positions of the work areas A1 to A4 are, as seen with reference to FIG. 2, defined by the position coordinates in the XI coordinate system with the origin at the bottom left corner of the floor 100*a* constituting the space 100*a*. The X-coordinate of the position coordinates is equal to the distance from the origin in the direction parallel to the X-axis and the Y-coordinate thereof is equal to the distance from the origin in the direction parallel to the Y-axis as shown in the data table of FIG. 5. The sizes of the work areas A1 to A4 are defined by the dimension in the direction parallel to the X-axis (width) and the dimension in the direction parallel to the Y-axis (depth). The positions and sizes of the work areas A1 to A4 on the screen shown in FIG. 2 are defined by the seat position information 25*f*.

The control unit 22 is composed of a CPU, RAM (random access memory) serving as the work area of the CPU, and so on. The control unit 22 calculates the output power, operation mode, air-conditioned air discharge rate, and air-conditioned air discharge direction of each air conditioner 30 based on information stored in the storage unit 25. Then, the control unit 22 outputs the calculation results to the communication unit 21. Consequently, the calculation results are output to the air conditioners 30 via the communication unit 21. Furthermore, the control unit 22 receives information on the operation states of the air conditioners 30 and the like via the communication unit 21 and outputs the information to the display unit 23. Consequently, the air conditioners 30 can be monitored via the display unit 23.

Here, although not shown in FIG. 1, the air conditioning system 10 also has a heat exchanger (outdoor device) conducting heat exchange between the space 100 and outside air.

Returning to FIG. 1, the air conditioners 30 are each a device discharging air-conditioned air to the space 100. The air conditioners 30 are installed to the ceiling of the space 100 and discharges air-conditioned air in four directions. For example, as seen with reference to FIG. 2, the air conditioners 30 are arranged in a matrix of two rows and four columns and discharge air-conditioned air in the X-axis and Y-axis directions.

Figure 6:
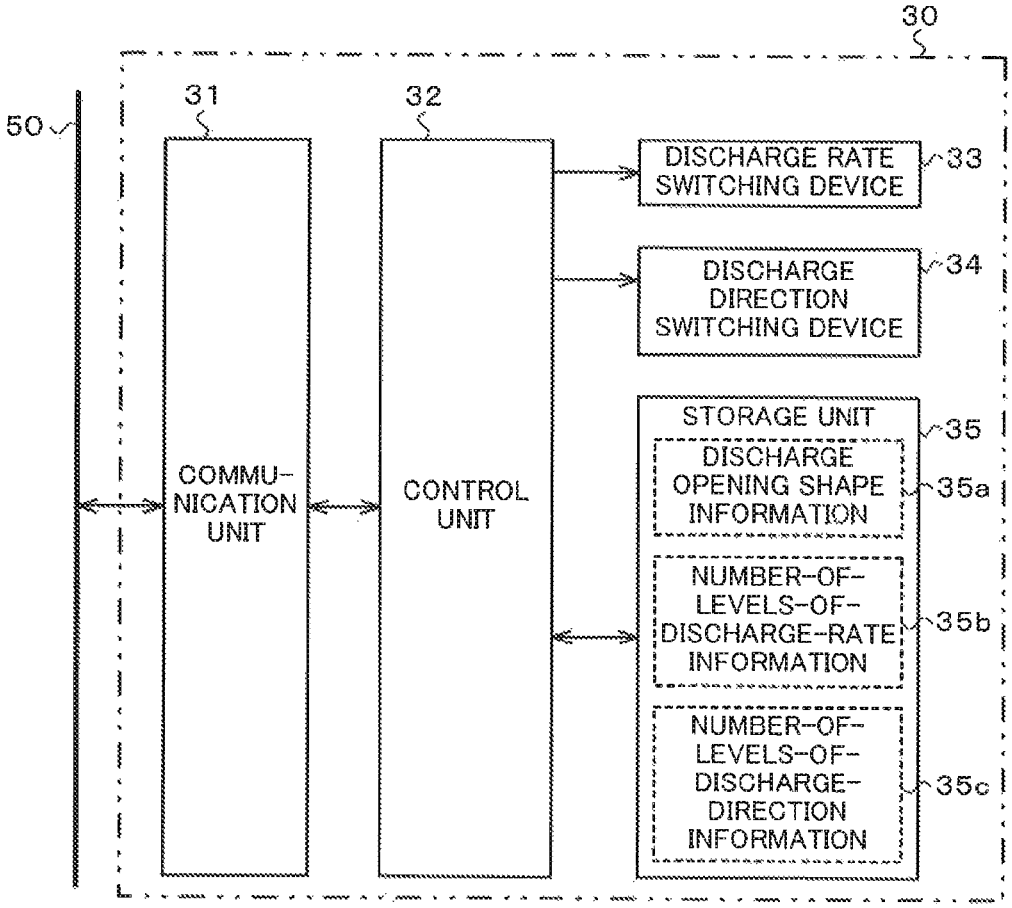
FIG. 6 is a block diagram of an air conditioner.

FIG. 6 is a block diagram of an air conditioner 30. As shown in FIG. 6, an air conditioner 30 has a communication unit 31, a control unit 32, a discharge rate switching device 33, a discharge direction switching device 34, and a storage unit 35.

The communication unit 31 is constructed to include, for example, an air conditioning control-specific communication interface, serial interface, or LAN interface. The air conditioner 30 is connected to the network 50 via the communication unit 31.

The discharge rate switching device 33 adjusts the air-conditioned air discharge rate among multiple levels based on instruction from the control unit 32. In this embodiment, the discharge rate switching device 33 adjusts the air-conditioned air discharge rate among four levels, high, moderate, low, and breeze, and discharges the air-conditioned air to the space 100.

The discharge direction switching device 34 has a louver for switching the air-conditioned air discharge direction in the vertical direction. Then, the discharge direction switching device 34 adjusts the air-conditioned air discharge direction among multiple levels of the vertical direction based on instruction from the control unit 32.

The storage unit 35 is constructed to include a nonvolatile memory such as a semiconductor memory. The storage unit 35 stores discharge opening shape information 35*a*, number-of-levels-of-discharge rate information 35*b*, and number-of-levels-of-discharge-direction information 35*c*.

The discharge opening shape information 35*a* is information for identifying the number of discharge openings and the shape of discharge openings.

The number-of-levels-of-discharge-rate information 35*b* is information for determining the maximum air-conditioned air discharge rate and among how many levels the maximum air-conditioned air discharge rate can be adjusted. The number-of-levels-of-discharge-rate information 35*b* makes it possible to determine whether the air conditioners 30 are capable of switching the air-conditioned air discharge rate, for example, among three levels, high, moderate, and low, or among four levels, high, moderate, low, and breeze.

The number-of-levels-of-discharge-direction information 35*c* is information for determining among how many levels the air-conditioned air discharge direction can be adjusted. The number-of-levels-of-discharge-direction information 35*c* makes it possible to determine whether the air conditioners 30 are capable of switching the air-conditioned air discharge direction, for example, among six levels at 15-degree intervals, among four levels at 22.5-degree intervals, or among three levels at 30-degree intervals in the vertical direction. Here, it is unnecessary that the angle is increased proportionally for each level and, for example, the angle for each level can be preset according to the model such as 10 degrees for the first level, 15 degrees for the second level, and 35 degrees for the third level.

The control unit 32 is composed of a CPU, RAM (random access memory) serving as the work area of the CPU, and so on. The control unit 32 communicates with the air conditioners 30 via the communication unit 31 when necessary. Furthermore, the control unit 32 outputs information regarding the ambient temperature of the air conditioners 30 that is acquired via not-shown sensors to the communication unit 31. The information output to the communication unit 31 is sent to the management device 20.

Figure 7:
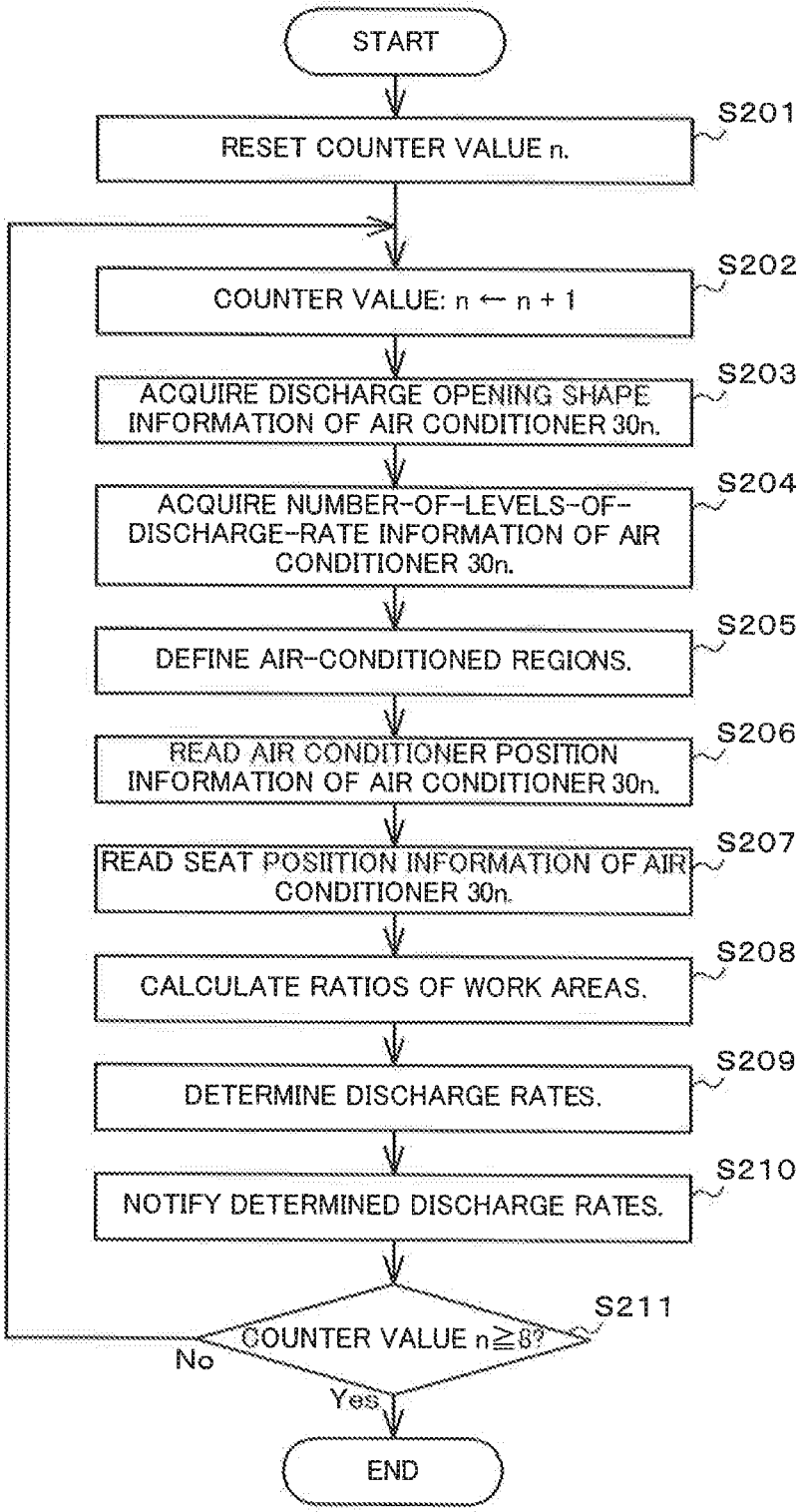
FIG. 7 is a flowchart for explaining the procedure to adjust the air-conditioned air discharge rate.

The procedure to adjust the discharge rate of each air conditioner 30 in the air conditioning system 10 having the above configuration will be described hereafter. Upon being started, the control unit 22 of the management device 20 reads and executes programs stored in the storage unit 25. Then, receiving an operation order from the user, for example, via the input unit 24, the control unit 22 executes the procedure presented by the flowchart shown in FIG. 7.

In the first step S201, the control unit 22 resets a counter value n.

In the next step S202, the control unit 22 increments the counter value n.

In the next step S203, the control unit 22 acquires the discharge opening shape information of the air conditioner $\mathbf{30}_1$ via the communication unit 21.

In the next step S204, the control unit 22 acquires the number-of-levels-of-discharge rate of the air conditioner $\mathbf{30}_1$ via the communication unit 21.

In the next step S205, the control unit 22 defines air-conditioned regions corresponding to the individual discharge openings of the air conditioner $\mathbf{30}_1$ based on the acquired discharge opening shape information 35*a* and number-of-levels-of-discharge-rate information 35*b*.

Figure 8:
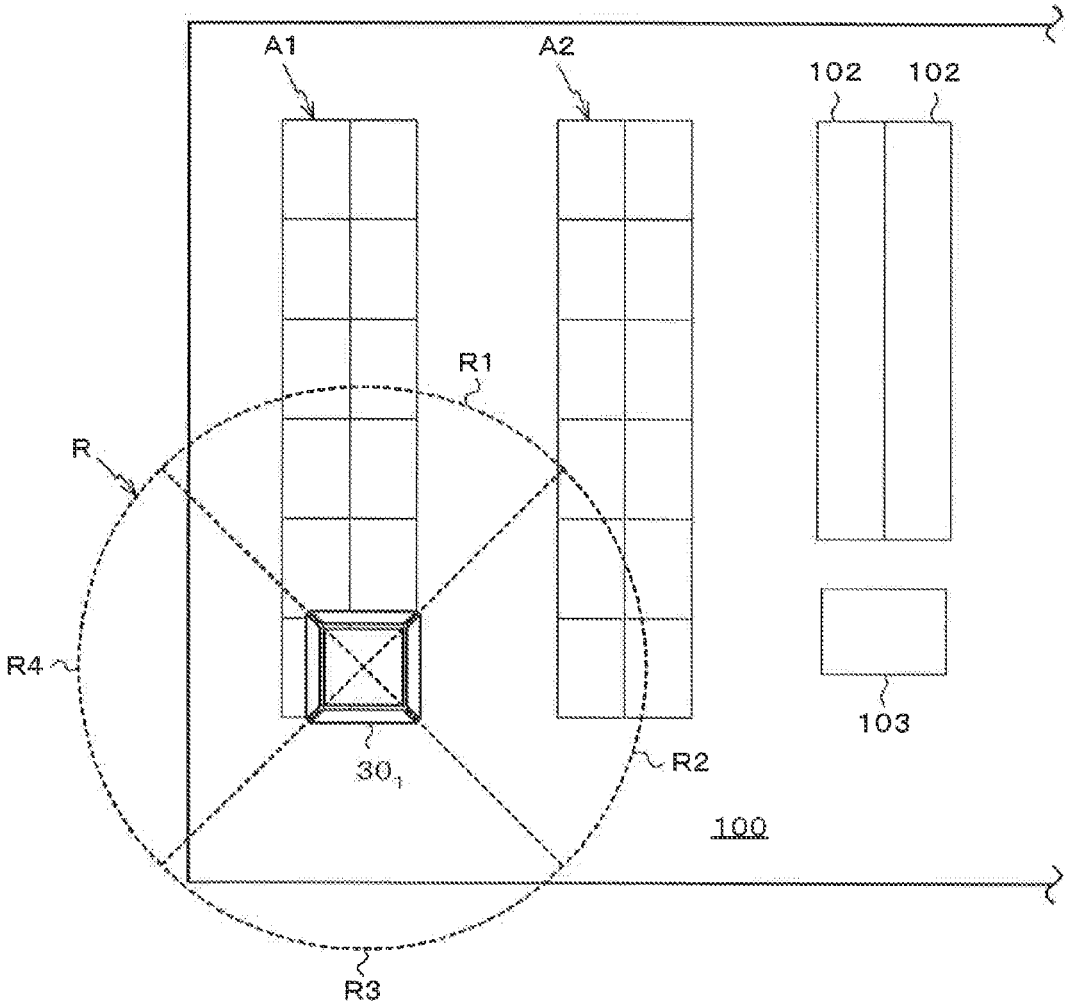
FIG. 8 is an illustration for explaining the procedure to adjust the air-conditioned air discharge rate (No. 1)

More specifically, first, the control unit 22 defines the entire air-conditioned region of the air conditioner $\mathbf{30}_1$ based on the discharge opening shape information 35*a* of the air conditioner $\mathbf{30}_1$. For example, if the air conditioner $\mathbf{30}_1$ has four discharge openings facing in different directions and the discharge openings are rectangular along the edges of the air conditioner $\mathbf{30}_1$, for example as shown in FIG. 8, a circular air-conditioned region R around the air conditioner $\mathbf{30}_1$ is specified. The radius of the air-conditioned region R is determined according to the maximum attainable distance of air-conditioned air discharged from the air conditioner $\mathbf{30}_1$.

Subsequently, the control unit 22 divides the circular air-conditioned region R based on the positions of the discharge openings. For example, if the air conditioner 30 has four discharge openings facing in different directions, the control unit 22 divides the air-conditioned region R into four sectorial air-conditioned regions R1 to R4 in accordance with the positions of the four discharge openings. Consequently, the air-conditioned regions R1 to R4 assigned to the individual discharge openings of the air conditioner 30 are defined. After defining the air-conditioned regions R1 to R4, the control unit 22 proceeds to the next step S206.

In the step S206, the control unit 22 reads the air conditioner position information 25*e* of the air conditioner $\mathbf{30}_1$ that is stored in the storage unit 25.

In the next step S207, the control unit 22 reads the seat position information 25*f* stored in the storage unit 25.

In the next step S208, the control unit 22 calculates the occupancy rate of the work areas A1 to A4 in each of the air-conditioned regions R1 to R4. For example as shown in FIG. 8, when the work area A1 is included in the air-conditioned region R1, the control unit 22 calculates the occupancy rate of the work area A1 in the air-conditioned region R1 based on the position of the air conditioner $\mathbf{30}_1$ that is included in the air conditioner position information 25*e*, and information regarding the position information (XY coordinates), width, and depth of the work area A1 that is included in the seat position information 25*f*. Similarly, the control unit 22 calculates the occupancy rates of the work areas in the air-conditioned regions R2 to R4.

In the next step S209, the control unit 22 determines the air-conditioned air discharge rates from the discharge openings of the air conditioner $\mathbf{30}_1$ according to the occupancy rates of the working areas in the air-conditioned regions R1 to R4. For example, if the work area occupancy rate is 60% or higher, the discharge rate is determined to be at a high level (maximum). Alternatively, if the occupancy rate is not lower than 40% but lower than 60%, the discharge rate is determined to be at a moderate level. Furthermore, if the occupancy rate is not lower than 20% but lower than 40%, the discharge rate is determined to be at a low level. Furthermore, if the occupancy rate is not lower than 5% but lower than 20%, the discharge rate is determined to be at a breeze level. Furthermore, if the occupancy rate is lower than 5%, the discharge rate is determined to be zero.

As shown in FIG. 8, the occupancy rate of the work area A1 in the air-conditioned region R1 is approximately 65%. Therefore, the air-conditioned air discharge rate from the discharge opening corresponding to the air-conditioned region R1 is determined to be at a high level. On the other hand, the occupancy rate of the work area A2 in the air-conditioned region R2 is approximately 30%. Therefore, the air-conditioned air discharge rate from the discharge opening corresponding to the air-conditioned region R2 is determined to be at a low level. Furthermore, the occupancy rate of the work area in the air-conditioned region R3 is 0%. Therefore, the air-conditioned air discharge rate from the discharge opening corresponding to the air-conditioned region R3 is determined to be zero. Furthermore, the occupancy rate of the work area A1 in the air-conditioned region R4 is approximately 10%. Therefore, the air-conditioned air discharge rate from the discharge opening corresponding to the air-conditioned region R4 is determined to be at a breeze level.

In the next step S210, the control unit 22 outputs information regarding the discharge rates from the discharge openings to the air conditioner $\mathbf{30}_1$ via the communication unit 21. Receiving the information regarding the discharge rates, the control unit 32 of the air conditioner $\mathbf{30}_1$ informs the discharge rate switching device 33 of the air-conditioned air discharge rates from the discharge openings. Consequently, the discharge rate switching device 33 adjusts the discharge rates from the discharge openings.

Figure 9:
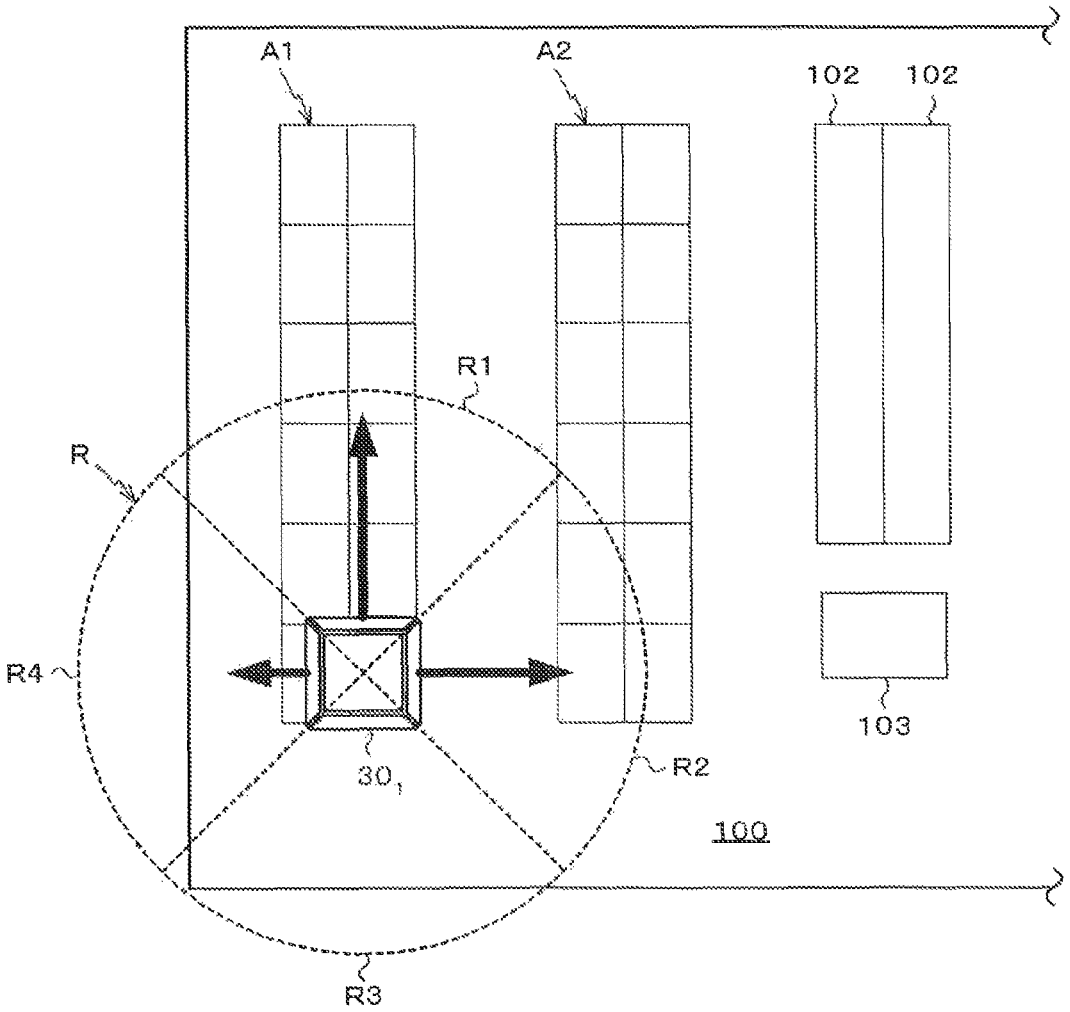
FIG. 9 is an illustration for explaining the procedure to adjust the air-conditioned air discharge rate (No. 2)

FIG. 9 is an illustration schematically showing the air-conditioned air discharge rates from the air conditioner $\mathbf{30}_1$. For example as indicated by the lengths of the arrows in FIG. 9, the air-conditioned air discharge rates discharged from the discharge openings of the air conditioner $\mathbf{30}_1$ are determined in accordance with the occupancy rates of the work areas in the air-conditioned regions R1 to R4 assigned to the discharge openings.

In the next step S211, the control unit 22 determines whether the counter value n is equal to or greater than eight. Here, if the determination is negated, the control unit 22 returns to the step S202. Then, the control unit 22 repeats the processing of the Steps S202 to S211 until the determination is affirmed in the Step 211. Consequently, the air-conditioned air discharge rates discharged from the discharge openings of the air conditioners $\mathbf{30}_2$ to $\mathbf{30}_8$ are adjusted in sequence.

On the other hand, if the determination is affirmed in the Step S211 (Step S211: Yes), the control unit 22 ends the discharge rate adjustment procedure.

Figure 10:
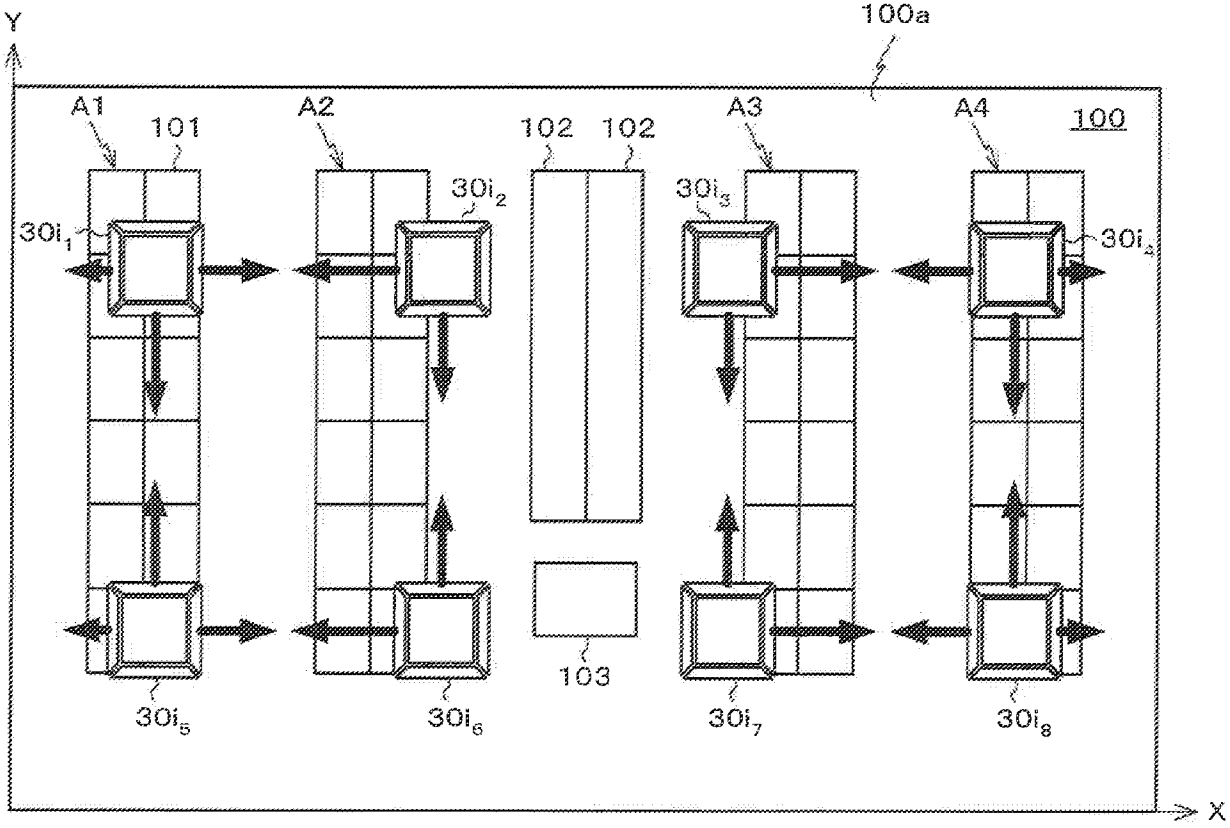
FIG. 10 is an illustration showing a screen displayed on the display unit after the air-conditioned air discharge rate has been adjusted.

FIG. 10 is an illustration showing a screen displayed on the display unit 23 after the discharge rates are adjusted. As indicated by the arrows in FIG. 10, the discharge openings of the air conditioners $\mathbf{30}_1$ to $\mathbf{30}_8$ discharge air-conditioned air in the amounts defined according to the occupancy rates of the work areas A1 to A4 in the air-conditioned regions R1 to R4 assigned to the discharge openings of the air conditioners $\mathbf{30}_1$ to $\mathbf{30}_8$.

As described above, in this embodiment, the air-conditioned air discharge rates discharged from the discharge openings of the air conditioners $\mathbf{30}_1$ to $\mathbf{30}_8$ are adjusted according to the occupancy rates of the work areas A1 to A4 in the air-conditioned regions R1 to R4 assigned to the discharge openings of the air conditioners $\mathbf{30}_1$ to $\mathbf{30}_8$. Consequently, the work areas A1 to A4 consisting of the desks 101 are intensively air-conditioned and the space where the cabinets 102 and multifunctional machine 103 are provided and aisles are moderately air-conditioned. Therefore, creating a comfortable environment around the users working in the space 100 and reduce the energy consumption required for air-conditioning the space 100 is possible.

In this embodiment, the air-conditioned air discharge rates discharged from the discharge openings are determined according to the occupancy rates of the work areas A1 to A4 in the corresponding air-conditioned regions R1 to R4. Therefore, the space 100 can efficiently be air-conditioned without using temperature sensors for measuring the temperatures of the work areas and their vicinities or distance sensors for measuring the distances between the air conditioners 30 and the work areas. Therefore, a low cost device can be provided.

In this embodiment, the air-conditioned air discharge rates discharged from the discharge openings are determined according to the occupancy rates of the work areas A1 to A4 in the corresponding air-conditioned regions R1 to R4. Therefore, even if the layout of the desks 101 is changed, the occupancy rates of the work areas in the air-conditioned regions are recalculated after the layout is changed and the proper discharge rates for the discharge openings are redetermined. Therefore, air conditioning responding flexibly to change of the layout in the space 100 can be realized.

In this embodiment, the control unit 22 of the management device 20 determines the discharge rates among four levels, high, moderate, low, and breeze. This is not restrictive. The control unit 22 of the management device 20 can calculate discharge rates X (L/s) according to the occupancy rates of the work areas A1 to A4 in the air-conditioned regions R1 to R4 and output the discharge rates X to the air conditioners 30. In such a case, the control unit 32 of the air conditioners 30 sets the discharge rates to the levels corresponding to the discharge rates X.

In this embodiment, the discharge rates from the discharge openings are determined according to the occupancy rates of the working areas in the air-conditioned regions assigned to the discharge openings of the air conditioners 30. More specifically, if the work area occupancy rate is 60% or higher, the discharge rate is determined to be at a high level (maximum). Alternatively, if the occupancy rate is not lower than 40% and lower than 60%, the discharge rate is determined to be at a moderate level. Furthermore, if the occupancy rate is not lower than 20% and lower than 40%, the discharge rate is determined to be at a low level. Furthermore, if the occupancy rate is not lower than 5% and lower than 20%, the discharge rate is determined to be at a breeze level. Furthermore, if the occupancy rate is lower than 5%, the discharge rate is determined to be zero.

The above occupancy rate ranges are given by way of example. The optimum ranges can be determined for example according to the magnitude of occupancy of the work areas for ensuring that the air conditioning system 10 operates efficiently and the users are comfortable. For example, if the work areas are smaller than the work areas A1 to A4 in this embodiment, the occupancy rates of the work areas in the air-conditioned regions are lower. Alternatively, if the work areas are larger than the work areas A1 to A4 in this embodiment, the occupancy rates of the work areas in the air-conditioned regions are higher. Therefore, the control unit 22 of the management device 20 can determine the occupancy rate ranges in consideration of the areas of the work areas and/or the ratios of the work areas to the floor 100*a*. Consequently, the air conditioning system 10 operating efficiently and the users being comfortable is ensured.

(Embodiment 2)

An air conditioning system 10 according to Embodiment 2 of the present invention will be described hereafter. The same or equivalent structures as or to those in Embodiment 1 will be referred to by the same reference numbers and their explanation will be omitted or simplified.

The air conditioning system 10 according to this embodiment is different from the air conditioning system 10 according to Embodiment 1 in that the louver angle is adjusted according to the occupancy rate of the work areas in the air-conditioned region so as to adjust the air-conditioned air discharge direction.

Figure 11:
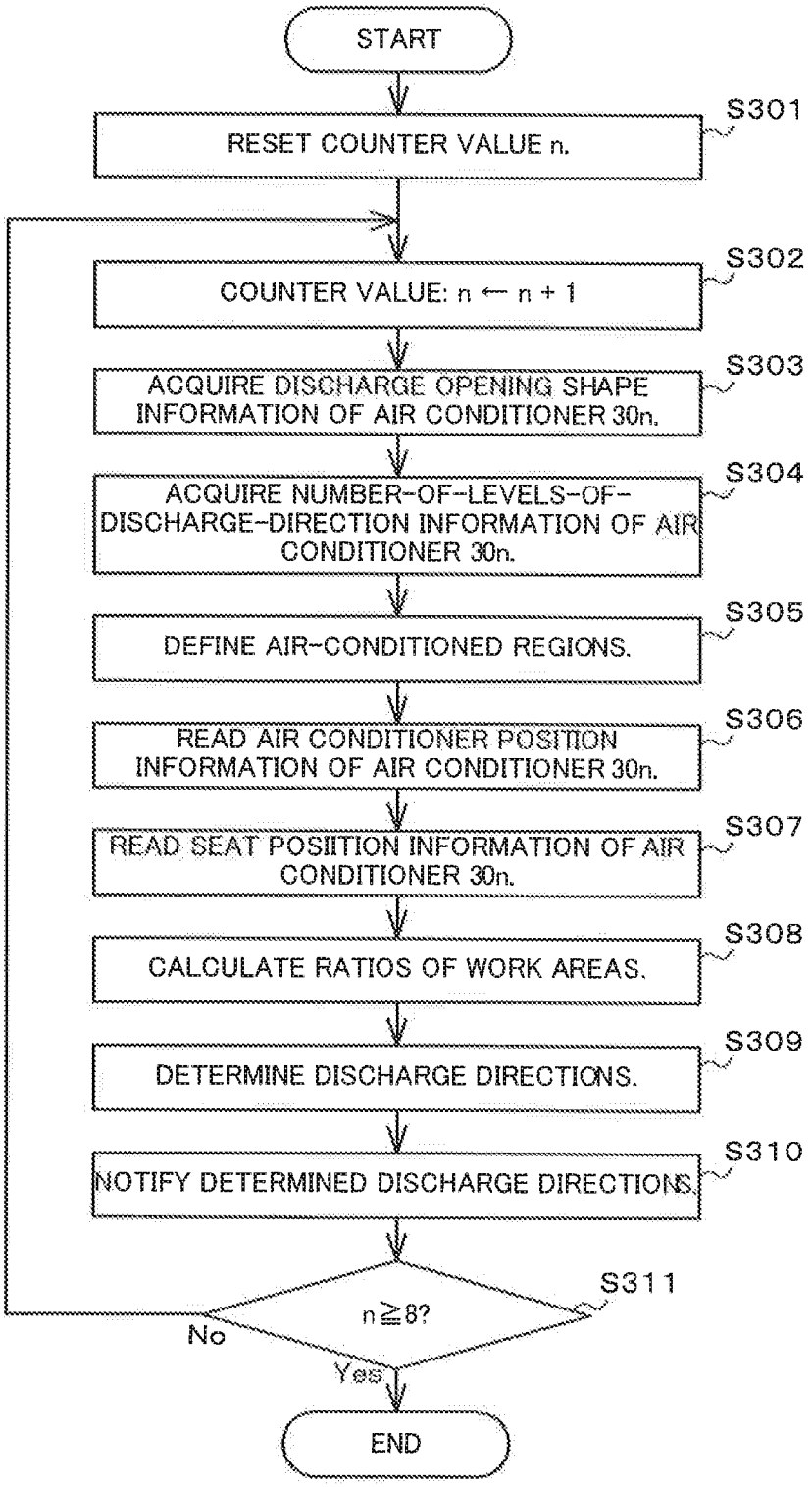
FIG. 11 is a flowchart for explaining the procedure to adjust the air-conditioned air discharge direction.

The discharge direction adjustment procedure according to this embodiment will be described hereafter. Upon being started, the control unit 22 of the management device 20 reads and executes programs stored in the storage unit 25. Then, receiving an operation order from the user, for example, via the input unit 24, the control unit 22 executes the procedure presented by the flowchart shown in FIG. 11.

In the first step 301, the control unit 22 resets a counter value n.

In the next step S302, the control unit 22 increments the counter value n.

In the next step S303, the control unit 22 acquires the discharge opening shape information of the air conditioner $\mathbf{30}_1$ via the communication unit 21.

In the next step S304, the control unit 22 acquires the number-of-levels-of-discharge-direction information of the air conditioner $\mathbf{30}_1$ via the communication unit 21.

In the next step S305, the control unit 22 defines the air-conditioned regions corresponding to the discharge openings of the air conditioner $\mathbf{30}_1$ based on the acquired discharge opening shape information 35*a* and number-of-levels-of-discharge-direction information 35*c*.

Figure 12:
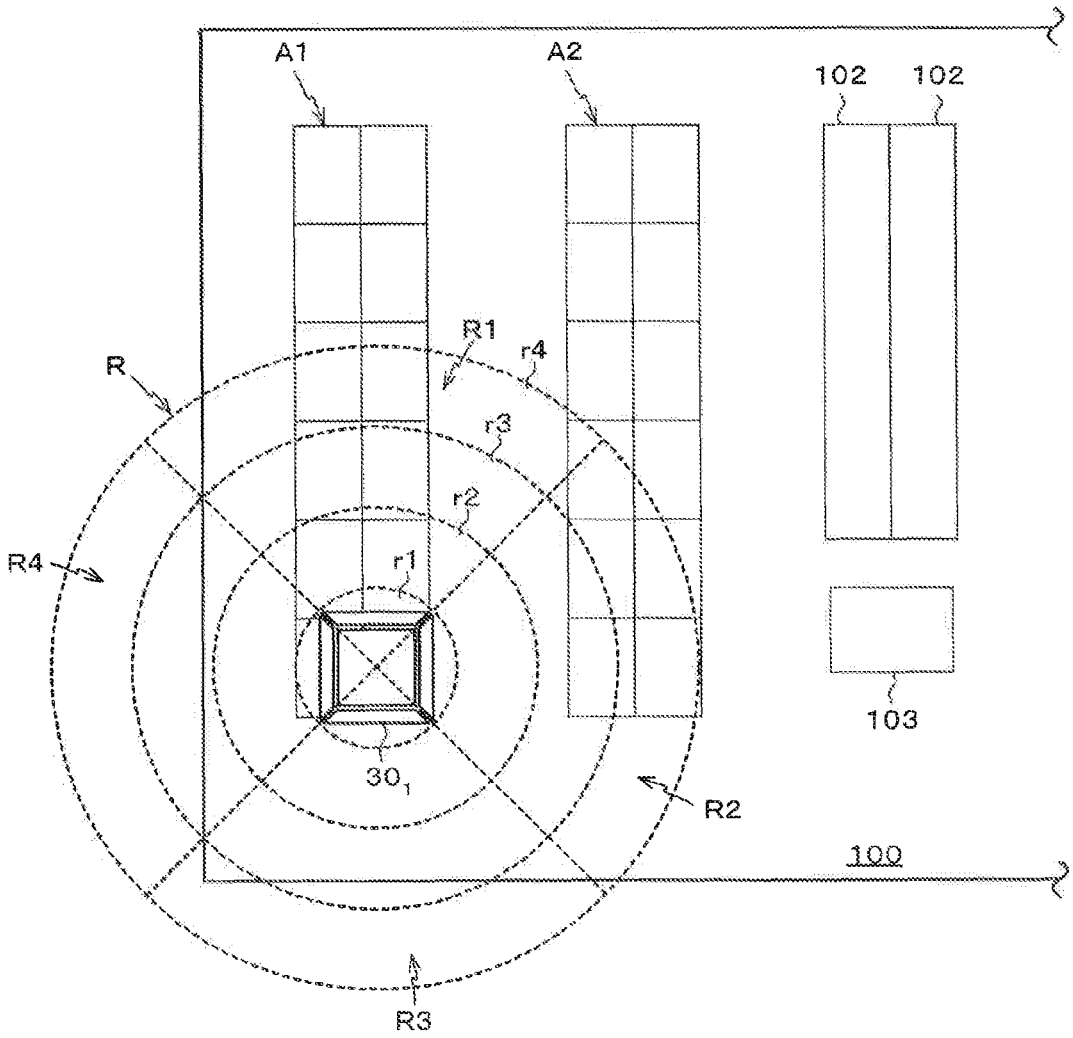
FIG. 12 is an illustration for explaining the procedure to adjust the air-conditioned air discharge direction.

More specifically, first, the control unit 22 defines the entire air-conditioned region of the air conditioner $\mathbf{30}_1$ based on the discharge opening shape information 35*a* of the air conditioner $\mathbf{30}_1$. For example, if the air conditioner $\mathbf{30}_1$ has four discharge openings facing in different directions and the discharge openings are rectangular along the edges of the air conditioner $\mathbf{30}_1$, for example as shown in FIG. 12, a circular air-conditioned region R around the air conditioner $\mathbf{30}_1$ is specified. The radius of the air-conditioned region R is determined according to the maximum attainable distance of air-conditioned air discharged from the air conditioner $\mathbf{30}_1$.

Subsequently, the control unit 22 divides the circular air-conditioned region R based on the positions of the discharge openings. For example, if the air conditioner 30 has four discharge openings facing in different directions, the control unit 22 divides the air-conditioned region R into four sectorial air-conditioned regions R1 to R4 in accordance with the positions of the discharge openings. Consequently, the air-conditioned regions R1 to R4 assigned to the individual discharge openings of the air conditioner $\mathbf{30}_1$ are defined.

Subsequently, the control unit 22 divides each of the air-conditioned regions R1 to R4 according to the number of switchable levels of discharge direction. For example, if the air conditioner $\mathbf{30}_1$ is capable of adjusting the discharge direction among four levels in the vertical direction, the air-conditioned region R1 is equally divided into four according to the distance from the air conditioner $\mathbf{30}_1$. Consequently, as shown in FIG. 12, four sectorial air-conditioned regions r1 to r4 having the same central angle are defined.

The control unit 22 executes the above processing also on the air-conditioned regions R2 to R4. Consequently, the air-conditioned regions R2 to R4 are each divided and four sectorial air-conditioned regions r1 to r4 are defined in each of the air-conditioned regions R2 to R4. After defining the air-conditioned regions r1 to r4 in each of the air-conditioned regions R1 to R4, the control unit 22 proceeds to the next step S306.

In the step S306, the control unit 22 reads the air conditioner position information 25*e* of the air conditioner $\mathbf{30}_1$ that is stored in the storage unit 25.

In the step S307, the control unit 22 reads the seat position information 25*f* stored in the storage unit 25.

In the step S308, the control unit 22 calculates the occupancy rate of the work areas A1 to A4 in each of the air-conditioned regions R1 to R4 for each of the air-conditioned regions r1 to r4. For example as shown in FIG. 12, when the work areas A1 and A2 are included in the air-conditioned region R1, the control unit 22 calculates the occupancy rate of the work areas A1 and A2 in the air-conditioned region R1 based on the position of the air conditioner $\mathbf{30}_1$ that is included in the air conditioner position information 25*e* and information regarding the position information (XY coordinates), width, and depth of the work areas A1 and A2 that is included in the seat position information 25*f* for each of the air-conditioned regions r1 to r4. Similarly, the control unit 22 calculates the occupancy rates of the work areas in the air-conditioned regions R2 to R4 for each of the air-conditioned regions r1 to r4.

In the next step S309, the control unit 22 determines the discharge direction of air-conditioned air discharged from the discharge opening corresponding to the air-conditioned region R1 in accordance with the occupancy rates of the work areas in the air-conditioned regions r1 to r4 constituting the air-conditioned region R1.

Figure 13:
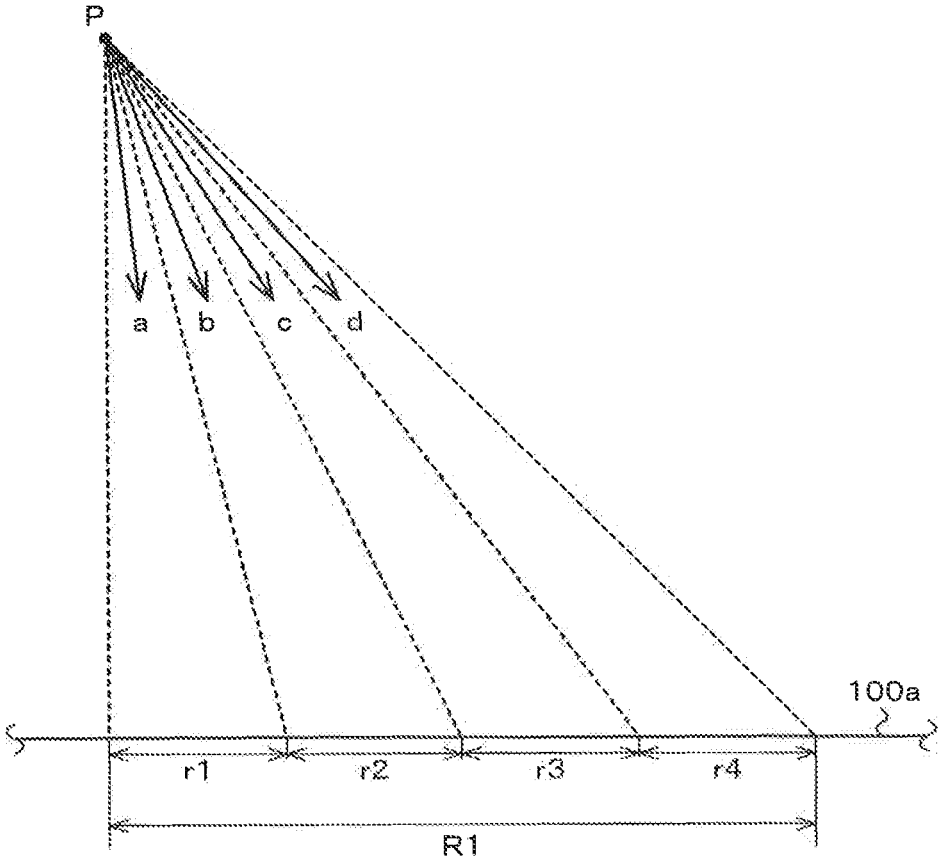
FIG. 13 is an illustration showing the positional relationship between a discharge opening and air-conditioned regions.

FIG. 13 is an illustration showing the positional relationship between a discharge opening indicated by a point P and the air-conditioned regions r1 to r4. For example, as shown in FIG. 13, provided that the air conditioner $\mathbf{30}_1$ is capable of adjusting the discharge direction among four levels as indicated by the arrows a to d, the control unit 22 selects the discharge direction indicated by the arrow a when the occupancy rate of the work areas in the air-conditioned region r1 is the highest. On the other hand, the control unit 22 selects the discharge direction indicated by the arrow b when the occupancy rate of the work areas in the air-conditioned region r2 is the highest. Furthermore, the control unit 22 selects the discharge direction indicated by the arrow c when the occupancy rate of the work areas in the air-conditioned region r3 is the highest. Furthermore, the control unit 22 selects the discharge direction indicated by the arrow d when the occupancy rate of the work areas in the air-conditioned region r4 is the highest. The control unit 22 determines the air-conditioned air discharge directions from the discharge openings corresponding to the air-conditioned regions R2 to R4 through the above processing.

Here, if the air-conditioned region includes no work area or the occupancy rates of the work areas in the air-conditioned regions r1 to r4 are equal, swinging the louver is possible so as to switch the discharge direction from the direction indicated by the arrow a up to the direction indicated by the arrow d in sequence.

In the next step S310, the control unit 22 outputs information regarding the discharge directions of air-conditioned air discharged from the discharge openings to the air conditioner $\mathbf{30}_1$ via the communication unit 21. Receiving the information regarding the discharge directions, the control unit 32 of the air conditioner $\mathbf{30}_1$ informs the discharge direction switching device 34 of the air-conditioned air discharge directions. Consequently, the discharge direction switching device 34 adjusts the discharge directions at the discharge openings.

In the next step S311, the control unit 22 determines whether the counter value n is equal to or greater than eight. If the determination is negated (Step S311, No), the control unit 22 returns to the step S302. Then, the control unit 22 repeats the processing of the steps S302 to S311 until the determination is affirmed in the step S311. Consequently, the discharge directions of air-conditioned air discharged from the discharge openings of the air conditioners $\mathbf{30}_2$ to $\mathbf{30}_8$ are adjusted in sequence.

On the other hand, if the determination is affirmed in the step S311 (Step S311: Yes), the control unit 22 ends the discharge directions adjustment procedure.

As described above, in this embodiment, the discharge directions of air-conditioned air discharged from the discharge openings of the air conditioners $\mathbf{30}_1$ to $\mathbf{30}_8$ are adjusted according to the occupancy rates of the work areas A1 to A4 in the air-conditioned regions assigned to the discharge openings of the air conditioners $\mathbf{30}_1$ to $\mathbf{30}_8$. Consequently, the work areas A1 to A4 consisting of the desks 101 are intensively air-conditioned and the space where the cabinets 102 and multifunctional machine 103 are provided and aisles are moderately air-conditioned. Therefore, creating a comfortable environment around the users working in the space 100 and reducing the energy consumption required for air-conditioning the space 100 is possible.

In this embodiment, priority is given to the work areas where people are present for discharging air-conditioned air. Therefore, the users feel a lower temperature and the temperature of the air conditioners are maintained at a high level. Consequently, reducing the energy consumption required for air-conditioning the space 100 is possible.

In this embodiment, the discharge directions of air-conditioned air discharged from the discharge openings are determined according to the occupancy rates of the work areas A1 to A2 in the corresponding air-conditioned regions R1 to R4. Therefore, even if the layout of the desks 101 is changed, the occupancy rates of the work areas in the air-conditioned regions are recalculated after the layout is changed and the proper discharge directions for the discharge openings are redetermined. Therefore, air conditioning responding flexibly to change of the layout in the space 100 can be realized.

Here, in this embodiment, the air-conditioned regions R1 to R4 are divided into four air-conditioned regions r1 to r4 according to the distance from the air conditioner 30. This is not restrictive. The air-conditioned regions R1 to R4 can be divided in consideration of the distance between the air conditioner 30 and floor 100*a*. For example, the air-conditioned regions R1 to R4 can be divided into multiple regions so that the air-conditioned regions r1 to r4 are equal in area.

In this embodiment, the air-conditioned regions R1 to R4 are divided into four air-conditioned regions r1 to r4 according to the number of levels of discharge direction. This is not restrictive. The air-conditioned regions R1 to R4 can be divided into two, three, or five or more air-conditioned regions.

Some embodiments of the present invention are described above. The present invention is not restricted to the above embodiments. For example, of the above embodiments, the discharge rate is adjusted in Embodiment 1 and the discharge direction is adjusted in Embodiment 2. This is not restrictive. The air conditioning system 10 can have both capabilities of adjusting the discharge rate and adjusting the discharge direction.

In such a case, adjusting the discharge rate according to the discharge direction is possible. For example, as the air-conditioned air discharge direction is adjusted, the path length for the air-conditioned air to reach the air-conditioned region changes. In such a case, the discharge rate can be increased in proportion to the path length. Consequently, creating a comfortable circumstance around the users regardless of the distance from the air conditioner 30 is possible. Furthermore, air-conditioning the space 100 efficiently without causing uneven temperature profiles is possible.

Furthermore, the number of levels of discharge rate or discharge direction of the air conditioner 30 may be defined by, for example, a parameter for a program executed by the control unit 32 of the air conditioner 30 or defined by a DIP switch provided to the air conditioner 30.

In the above embodiments, the icons 30*i* and work areas A1 to A4 displayed on the screen are placed based on the air conditioner position information 25*e* and seat position information 25*f*. This is not restrictive. The icons 30*i* and work areas A1 to A4 can be placed by, for example, the administrator of the air conditioning system 10 or the like.

In the above embodiments, the work areas A1 to A4 are defined by the desks 101. This is not restrictive. The work areas can be additionally set by the administrator of the air conditioning system 10.

In the above embodiments, an image of the floor 100*a* of the space 100 is entered by the administrator. This is not restrictive. The management device 20 could acquire a floor layout via a scanner or the like. In such a case, if the layout is marked with symbols presenting the work areas A1 to A4 and air conditioners 30, information equivalent to the air conditioner position information 25*e* and seat information 25*f* can be obtained. Consequently, the initial setting of the air conditioning system 10 can easily be done.

In the above embodiments, the air conditioner 30 is capable of discharging air-conditioned air in four directions. This is not restrictive. The air conditioner 30 may discharge air-conditioned air in three, two, or one direction, or may discharge air-conditioned air in five or more directions. For example, the present invention is applicable to the case in which the air conditioner 30 provided near a wall of the space 100 is an air conditioner discharging air-conditioned air in one direction.

In the above embodiments, ail air conditioners 30 are capable of controlling the air-conditioned air discharge rate and discharge direction. This is not restrictive. The air conditioning system 10 may include some air conditioners that are incapable of controlling the air-conditioned air discharge rate or discharge direction. In such a case, appointing the areas in the space 100 excluding the air-conditioned regions of such air conditioners to the air-conditioned regions of the air conditioners 30 that are capable of controlling the air-conditioned air discharge rate and discharge direction, and adjust the air-conditioned air discharge rate and discharge direction according to the occupancy rates of the work areas in those air-conditioned regions is possible. In this way, the areas excluding the air-conditioned regions of the air conditioners that are incapable of controlling the air-conditioned air discharge rate or discharge direction are efficiently air-conditioned by the air conditioner 30. Consequently, creating a comfortable environment around the users and reduce the energy consumption required for air-conditioning the space 100 is possible.

In the above embodiment, the air conditioning system 10 has eight air conditioners 30. This is not restrictive. The air conditioning system 10 may have seven or less, or nine or more air conditioners 30.

Various embodiments and modifications are available to the present invention without departing from the broad sense of spirit and scope of the present invention. The above-described embodiments are given for explaining the present invention and do not confine the scope of the present invention. In other words, the scope of the present invention is set forth by the scope of claims, not by the embodiments. Various modifications made within the scope of claims and scope of significance of the invention equivalent thereto are considered to fall under the scope of the present invention.

This application is based on Japanese Patent Application No. 2010-210120, filed on Sep. 17, 2010, and the entire specification, scope of claims, and drawings of which are incorporated herein by reference.

INDUSTRIAL APPLICABILITY

The air conditioning system and air conditioning method of the present invention are suitable for air-conditioning a apace where the users work.

DESCRIPTION OF REFERENCE NUMERALS

10 Air conditioning system
20 Management device
21 Communication unit
22 Control unit
23 Display unit
24 Input unit
25 Storage unit
25*a* Air conditioner connection information
25*b* Air conditioner operation information
25*c* Air conditioner model information
25*d* Top view information
25*e* Air conditioner position information
25*f* Seat position information
30 Air conditioner
31*i* Icon
31 Communication unit
32 Control unit
33 Discharge rate switching device
34 Discharge direction switching device
35 Storage unit
35*a* Discharge opening shape information
35*b* Number-of-levels-of-discharge-rate information
35*c* Number-of-levels-of-discharge-direction information
50 Network
100 Space
100*a* Floor
101 Desk
102 Cabinet
103 Multifunctional machine
A1 to A4 Work area
R, R1 to R4, r1 to r4 Air-conditioned region

The invention claimed is:

1. An air conditioning system, comprising:

at least one of discharge rate adjuster and angle adjuster based on an occupancy ratio of user work areas to an air-conditioned region defined for a space, the occupancy ratio being obtained from position information on an air conditioner and position information on the user work areas pre-defined in the space;

multiple discharge openings disposed in the space to be air-conditioned and discharging air-conditioned air; and a discharge rate calculator calculating, for each of the discharge openings, the discharge rate of the air-conditioned air discharged from the discharge opening according to the occupancy ratio of user work areas to the air-conditioned region assigned to the discharge opening; wherein the discharge rate adjuster adjusts, based on the occupancy ratio of the user work areas to the air-conditioned region defined for the space, a discharge rate of an air-conditioned air discharged to the air-conditioned region, the angle adjuster adjusts, based on the occupancy ratio of the user work areas to the air-conditioned region defined for the space, an angle of a discharge direction of the air-conditioned air, and the discharge rate adjuster adjusting the discharge rates of the air-conditioned air discharged from the discharge openings based on the calculation results of the discharge rate calculator, wherein the air-conditioned region, from which the occupancy ratio is obtained:

corresponds to an individual discharge opening of the air conditioner, and is based on (i) a shape of the individual discharge opening, (ii) discharge direction information of the individual discharge opening, and (iii) distance of air-conditioned air which is discharged from the individual discharge opening.

2. The air conditioning system according to claim 1, provided with first air conditioners dispersed in the space comprising the discharge openings and discharge rate adjuster.

3. The air conditioning system according to claim 2, wherein the discharge rate calculator calculates the discharge rates of the air-conditioned air discharged from the discharge openings based on position information on the first air conditioners in the space and position information on the user work areas in the space.

4. The air conditioning system according to claim 1, wherein the discharge rate calculator sets the discharge rate to zero when the occupancy ratio of the user work areas to the air-conditioned region is zero.

5. The air conditioning system according to claim 2, wherein when second air conditioners of which the air-conditioned air discharge rate is unchangeable are provided in the space, the discharge rate calculator calculates the discharge rates of the air-conditioned air on an assumption that the air-conditioned regions of the first air conditioners are the regions excluding the air-conditioned regions of the second air conditioners.

6. The air conditioning system according to claim 1, comprising:

first air conditioners dispersed in a space to be air-conditioned and adapted to change the angle of the air-conditioned air discharge direction among multiple levels from the horizontal direction to the vertical direction;

a specifier dividing the air-conditioned region of the first air conditioner into multiple small regions based on the distance from the installation position of the first air conditioner and specifying a small region including area the users work in most;

an angle calculator calculating the angle of the discharge direction for discharging the air-conditioned air toward the small region specified by the specifier; and the angle adjuster adjusting the angle of the discharge direction based on the calculation results of the angle calculator.

7. The air conditioning system according to claim 6, comprising a discharger discharging air-conditioned air in amounts corresponding to the distance between the small region specified by the specifier and the first air conditioner.

8. The air conditioning system according to claim 6, wherein when second air conditioners of which the air-conditioned air discharge rate is unchangeable are provided in the space, the specifier specifies the small region on an assumption that the air-conditioned regions of the first air conditioners are the regions excluding the air-conditioned regions of the second air conditioners.

9. The air conditioning system according to claim 1, comprising a work area-specifying specifying the work area from the positions of desks appearing in a floor image of the space.

10. The air conditioning system according to claim 1, further comprising a control unit which controls adjustment of the discharge rate adjuster to control the discharge rate of the air-conditioned air, and controls adjustment of the angle adjuster to control the angle of the discharge direction of the air-conditioned air.

11. An air conditioning method, including:

providing at least one of discharge rate adjuster and angle adjuster based on an occupancy ratio of user work areas to an air-conditioned region defined for a space, the occupancy ratio being obtained from position information on an air conditioner and position information on the user work areas pre-defined in the space;

providing multiple discharge openings disposed in the space to be air-conditioned and discharging air-conditioned air;

calculating, for each of the discharge openings, the discharge rate of the air-conditioned air discharged from the discharge opening according to the occupancy ratio of user work areas to the air-conditioned region assigned to the discharge opening;

in the at least one of the discharge rate adiuster and the angle adiuster, at least one of adjusting, based on the occupancy ratio of user work areas to the air-conditioned region defined for the space, at least one of a discharge rate of an air-conditioned air discharged to the air-conditioned region, and adjusting, based on the occupancy ratio of the user work areas to the air-conditioned region defined for the space, an angle of a discharge direction of the air-conditioned air, and discharging the air-conditioned air from each of the discharge openings at the calculated discharge rate, wherein the air-conditioned region, from which the occupancy ratio is obtained:

corresponds to an individual discharge opening of the air conditioner, and is based on (i) a shape of the individual discharge opening, (ii) discharge direction information of the individual discharge opening, and (iii) distance of air-conditioned air which is discharged from the individual discharge opening.

12. The air conditioning method according to claim 11, for air-conditioning the space to be air-conditioned using air conditioners dispersed in the space and adapted to change the angle of the air-conditioned air discharge direction among multiple levels from the horizontal direction to the vertical direction, including:

dividing the air-conditioned region of the air conditioner into multiple small regions based on the distance from the installation position of the air conditioner;

specifying a small region including the user work area most;

calculating the angle of the discharge direction for discharging the air-conditioned air toward the specified small region; and adjusting the angle of the discharge direction for the calculated angle.

13. The air conditioning method according to claim 11, wherein the adjusting is performed by a control unit which controls adjustment of the at least one of the discharge rate of the air-conditioned air and the angle of the discharge direction of the air-conditioned air.

* * * * *